US009121312B2

(12) United States Patent
Kawamura

(10) Patent No.: US 9,121,312 B2
(45) Date of Patent: Sep. 1, 2015

(54) VALVE TIMING CONTROL APPARATUS

(75) Inventor: Futoshi Kawamura, Kariya (JP)

(73) Assignees: DENSO CORPORATION, Kariya (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 13/352,465

(22) Filed: Jan. 18, 2012

(65) Prior Publication Data

US 2012/0186545 A1 Jul. 26, 2012

(30) Foreign Application Priority Data

Jan. 20, 2011 (JP) ..... 2011-10099

(51) Int. Cl.
*F01L 1/344* (2006.01)

(52) U.S. Cl.
CPC ..... *F01L 1/3442* (2013.01); *F01L 2001/34433* (2013.01); *F01L 2001/34456* (2013.01); *F01L 2001/34469* (2013.01)

(58) Field of Classification Search
CPC ..... F01L 1/3442; F01L 2001/34433; F01L 2001/34463; F01L 2001/34456
USPC ..... 123/90.15, 90.17, 90.31
See application file for complete search history.

(56) References Cited

U.S. PATENT DOCUMENTS 4,452,188 A * 6/1984 Kosuda et al. ..... 123/90.18
6,202,610 B1 * 3/2001 Yoshiki et al. ..... 123/90.15
7,182,052 B2 * 2/2007 Yaoko et al. ..... 123/90.17
7,261,072 B2 8/2007 Schmitt
7,444,964 B2 * 11/2008 Kanada et al. ..... 123/90.15
2002/0062803 A1 * 5/2002 Sato et al. ..... 123/90.17
2002/0139332 A1 * 10/2002 Takenaka ..... 123/90.17
2010/0305835 A1 12/2010 Inoue et al.
2010/0313835 A1 * 12/2010 Yamaguchi et al. ..... 123/90.15
2011/0259289 A1 * 10/2011 Fujiyoshi ..... 123/90.15

FOREIGN PATENT DOCUMENTS

JP 2010-275970 5/2009

OTHER PUBLICATIONS

Notification of Reason(s) for Refusal in JP 2011-010099 dated Jul. 30, 2014 (with partial English translation).
Japanese Notification of Reasons for Refusal issued for Japanese Patent Application No. 2011-010099, dated Feb. 4, 2014 (with partial English translation).
Office Action issued in corresponding German Application No. 102012200801.2 dated Mar. 24, 2015 (with translation).

* cited by examiner

*Primary Examiner* — Thai Ba Trieu
*Assistant Examiner* — Jason T Newton
(74) *Attorney, Agent, or Firm* — Nixon & Vanderhye P.C.

(57) ABSTRACT

A driving portion is configured to cause a driving force to move a spool in a first direction, and a bias unit is configured to cause a biasing force to bias the spool in a second direction in an axis direction. A part of a lock region is defined as a throttle region at which a flowing amount of working fluid flowing from a supply port to an introduction port is throttled. The throttle region is set to be located at a movable end position of the spool in the second direction to which the spool arrives when the driving force is not applied to the spool.

8 Claims, 9 Drawing Sheets

VALVE TIMING CONTROL APPARATUS

CROSS REFERENCE TO RELATED APPLICATION

This application is based on Japanese Patent Application No. 2011-10099 filed on Jan. 20, 2011, the disclosure of which is incorporated herein by reference in its entirety.

BACKGROUND OF THE INVENTION

1. Field of the Invention

The present invention relates to a valve timing control apparatus for controlling a valve timing of a valve, which is opened and closed by a camshaft according to a torque transmitted from a crankshaft in an internal combustion engine, by utilizing a working fluid supplied from a supply source.

2. Description of Related Art

Conventionally, a known valve timing control apparatus includes a housing, which is rotatable with rotation of a crankshaft, and a vane rotor, which is rotatable with rotation of a camshaft. JP-A-2010-285918 (US 2010/0313835 A1) describes a valve timing control apparatus in which a rotation phase of a vane rotor is changed toward advance side or retard side relative to a housing by introducing working fluid into an advance chamber or a retard chamber which are separated from each other in a rotation direction by the vane rotor in the housing.

The rotation phase is locked by a lock portion when the working fluid is discharged from a lock chamber, and is unlocked by the lock portion when the working fluid is introduced into the lock chamber. The working fluid discharged from or introduced into the lock chamber is controlled at the same timing as the working fluid discharged from or introduced into the advance/retard chamber by a control valve through a reciprocation of a spool in an axis direction.

The spool is moved based on a balance between a driving force of an electromagnetic solenoid and a biasing force of a spring. A moving area of the spool is set to have a variable region and a lock region. When the driving force is defined to be applied in a first direction, the biasing force is applied in a second direction opposite from the first direction, in the axis direction.

In the variable region, a lock activation port communicating with the lock chamber and an introduction port through which the working fluid is introduced into the advance chamber are connected to a supply port to which the working fluid is supplied from the supply source. In this case, the rotation phase, that is not locked, is changed into the advance side.

In the lock region, the introduction port is connected to the supply port, and the lock activation port is connected to a drain port from which the working fluid is discharged. In this case, the rotation phase is locked in a state that the advance chamber is filled with the working fluid. When the spool is moved from the lock region to the variable region, the working fluid can be introduced into the advance chamber that is already filled with the working fluid, so that the rotation phase can be quickly changed into the advance side.

Further, a part of the lock region is set as a throttle region at which a flowing amount of the working fluid is reduced from the supply port to the introduction port. In a case where the spool is moved from the variable region to the throttle region, the amount of the working fluid introduced into the advance chamber from the introduction port is reduced, so that advance-side variation amount of the rotation phase can be reduced. Thus, the vane rotor can be easily locked into a predetermined phase.

However, when the driving force is not applied to the spool, the spool reaches an end position of a movable area in the second direction. At a fail time when the driving force is not applied to the spool, the spool reaches the movable end position in the second direction. At this time, the flowing amount of the working fluid from the supply port to the introduction port is increased compared with the case of the throttle region, because the throttle region is located to be depart from the end position of the spool in the first direction. That is, at the fail time, the amount of the working fluid introduced into the advance chamber and the advance-side variation amount of the rotation phase are increased, so that it becomes difficult for the vane rotor to be locked into the predetermined phase. If the rotation phase cannot be locked at the fail time, the engine may have failure such as knocking, stall, or activation error.

SUMMARY OF THE INVENTION

In view of the foregoing and other problems, it is an object of the present invention to produce a fail-safe valve timing control apparatus having high-speed responsivity.

According to one aspect of the present invention, a valve timing control apparatus for controlling a valve timing of a valve configured to be opened and closed by a camshaft in accordance with a torque transmitted from a crankshaft of an internal combustion engine by utilizing working fluid supplied from a supply source comprising a housing, a vane rotor, a lock portion, a control valve, a driving portion and a bias unit. The housing is rotatable with the crankshaft. The vane rotor is rotatable with the camshaft, and partitions an interior of the housing into an advance chamber and a retard chamber in a rotation direction. The vane rotor is configured to change a rotation phase relative to the housing to an advance side or a retard side correspondingly when the working fluid is supplied into the advance chamber or the retard chamber. The lock portion has a lock chamber, and is configured to lock the vane rotor relative to the housing when the working fluid is discharged from the lock chamber. The lock portion is configured to release the lock when the working fluid is supplied into the lock chamber. The control valve controls a flow of the working fluid relative to the advance chamber, the retard chamber, and the lock chamber through a spool linearly movable in opposite directions including a first direction and a second direction. The driving portion is configured to cause a driving force to move the spool in the first direction based on a command signal, and the bias unit is configured to cause a biasing force to bias the spool in the second direction when being elastically deformed. The control valve has an introduction port introducing the working fluid into one of the advance chamber and the retard chamber; a lock activation port communicating with the lock chamber; a supply port receiving the working fluid from the supply source; and a drain port draining the working fluid. The spool is moved between a variable region and a lock region. The rotation phase is unlocked and changed by connecting the introduction port and the lock activation port to the supply port in the variable region. The rotation phase is locked by connecting the introduction port to the supply port and by connecting the lock activation port to the drain port in the lock region. A part of the lock region is defined as a throttle region at which a flowing amount of the working fluid flowing from the supply port to the introduction port is reduced. The throttle region is set to be located at a movable end position of the spool in the second direction to which the spool arrives when the driving force is not applied to the spool.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

Embodiment

Figure 1:
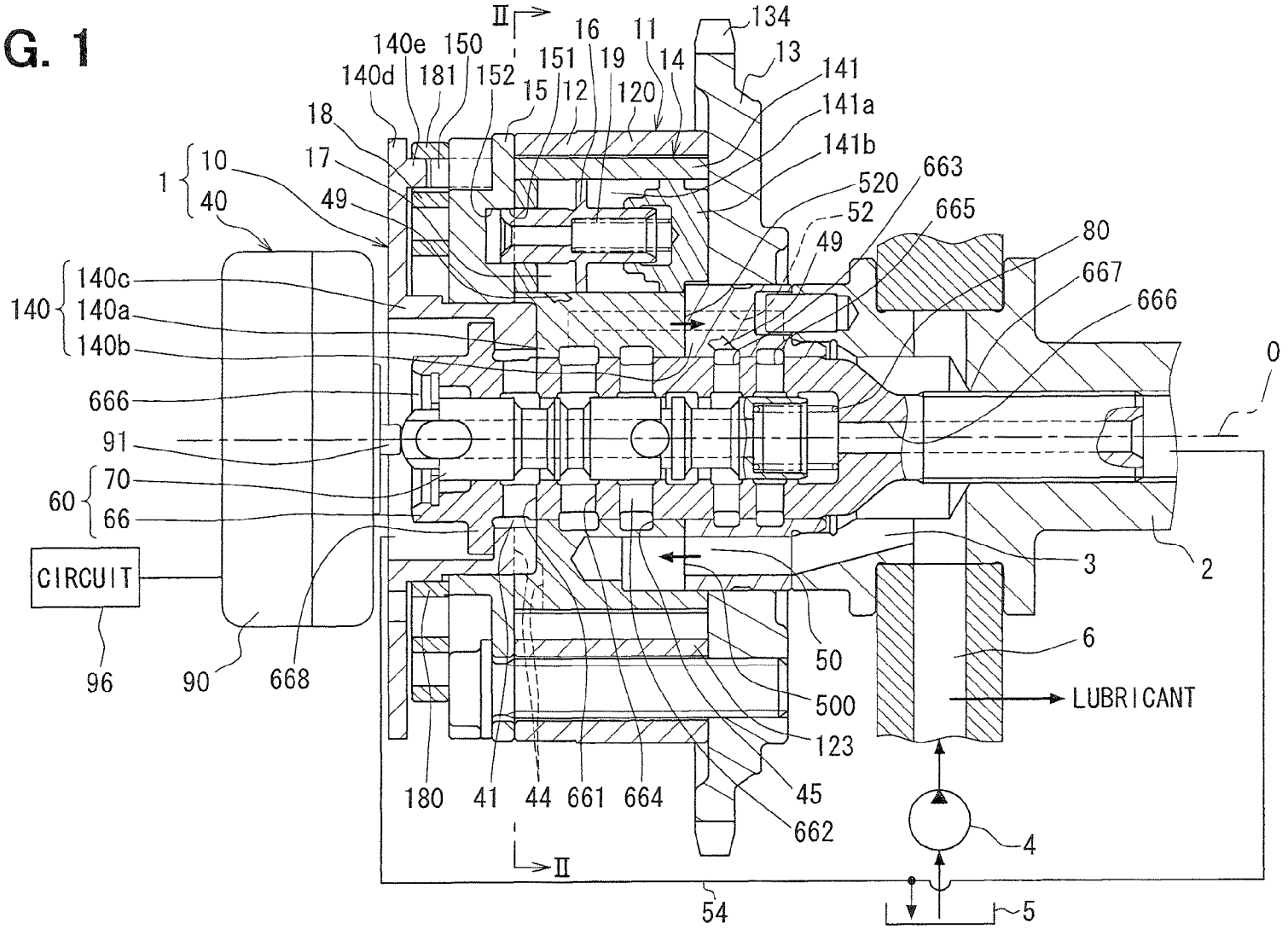
FIG. 1 is a sectional view showing a valve timing control apparatus according to an embodiment.

FIG. 1 shows an example of a valve timing control apparatus 1 according to a first embodiment which is applied to an internal combustion engine of a vehicle. FIG. 1 is a view taken along the line I-I in FIG. 2. The valve timing control apparatus 1 controls a valve timing of an intake valve by using a working fluid.

(Basic Construction)

The valve timing control apparatus 1 includes an actuator portion 10 and a control portion 40. The actuator portion 10 is provided to a transmission system, which transmits engine torque from a crankshaft (not shown) to a camshaft 2, and driven by the working fluid. The control portion 40 controls supply of the working fluid to the actuator portion 10.

(Actuator Portion)

In the actuator portion 10, a housing 11 has a shoe casing 12, and a rear plate 13 and a front plate 15 are coupled to ends of the casing 12, respectively, in the axis direction. The shoe casing 12 includes a tubular housing body 120 and multiple shoes 121, 122, 123. The shoes 121, 122, 123 function as partitioning parts. The shoes 121, 122, 123 are projected to the radially inner side from portions of the housing body 120. The portions of the shoes 121, 122, 123 are spaced by a prescribed distance in a rotation direction of the housing body 120. The shoes 121, 122, 123, which are adjacent to each other in the rotation direction, form an accommodation chamber 20 therebetween.

The rear plate 13 includes a sprocket 134 to be connected with the crankshaft via a timing chain (not shown). According to the present structure, engine torque is transmitted from the crankshaft to the sprocket 134 during an operation of the internal combustion engine. Thereby, the housing 11 rotates in the clockwise rotation of FIG. 2 with rotation of the crankshaft.

The vane rotor 14 is accommodated coaxially in the housing 11, and is slidably in contact with the rear plate 13 and the front plate 15 at both sides in the axial direction. The vane rotor 14 includes a tubular rotation axis 140 and vanes 141, 142, 143. The rotation axis 140 is coaxially fixed to the camshaft 2. In the present structure, the vane rotor 14 is rotatable in the clockwise rotation of FIG. 2 with rotation of the camshaft 2. In addition, the vane rotor 14 is rotatable relative to the housing 11.

The rotation axis 140 includes a main body 140*a*, a boss 140*b*, and a bush 140*c*. The axial main body 140*a* has both ends fixed with the boss 140*b* and the bush 140*c*. The boss 140*b* extends through the rear plate 13 in the axial direction. The boss 140*b* is fixed to the camshaft 2 outside the housing 11. The bush 140*c* extends through the front plate 15 in the axial direction. The bush 140*c* opens to the outside of the housing 11.

The vanes 141, 142, 143 project radially outward from portions of the axial main body 140*a* of the rotation axis 140. The portions of the axial main body 140*a* are spaced by a prescribed distance in the rotation direction. The vanes 141, 142, 143 are respectively accommodated in corresponding accommodation chambers 20.

The vanes 141, 142, 143 respectively partition the accommodation chambers 20 correspondingly to form advance chambers 22, 23, 24 and retard chambers 26, 27, 28 in the housing 11. An advance chamber 22 is formed between the shoe 121 and the vane 141. An advance chamber 23 is formed between the shoe 122 and the vane 142. An advance chamber 24 is formed between the shoe 123 and the vane 143. A retard chamber 26 is formed between the shoe 122 and the vane 141. A retard chamber 27 is formed between the shoe 123 and the vane 142. A retard chamber 28 is formed between the shoe 121 and the vane 143.

The vane 141 accommodates a lock member 16 to be fitted with a lock hole 152 of the front plate 15 so as to lock the rotation phase of the vane rotor 14 relative to the housing 11. Further, the vane 141 has a lock chamber 17 into which the working fluid such as oil is introduced to unlock the rotation phase by separating the lock member 16 from the lock hole 152.

In a state that the rotation phase is unlocked by the lock member 16, if working fluid is introduced into the advance chamber 22, 23, 24 and is discharged from the retard chamber 26, 27, 28, the rotation phase is advanced, so that the valve timing is advanced. In contrast, if working fluid is introduced into the retard chamber 26, 27, 28, and is discharged from the advance chamber 22, 23, 24, the rotation phase is retarded, so that the valve timing is retarded.

A regulation area is set for the rotation phase from a predetermined phase between the most retard phase and the most advance phase to the most advance phase, while the rotation phase is changed between the most advance phase and the most retard phase. The rotation phase is regulated into the regulation area when the engine is activated. Further, a middle lock phase is set in the regulation area so as to secure the suitable starting property, and the lock member 16 is locked at the middle lock phase. Thus, at the time of activating the engine, an amount of air drawn into a cylinder can be secured for the activation because the closing of the intake valve is restricted from being delayed.

(Control Portion)

Figure 2:
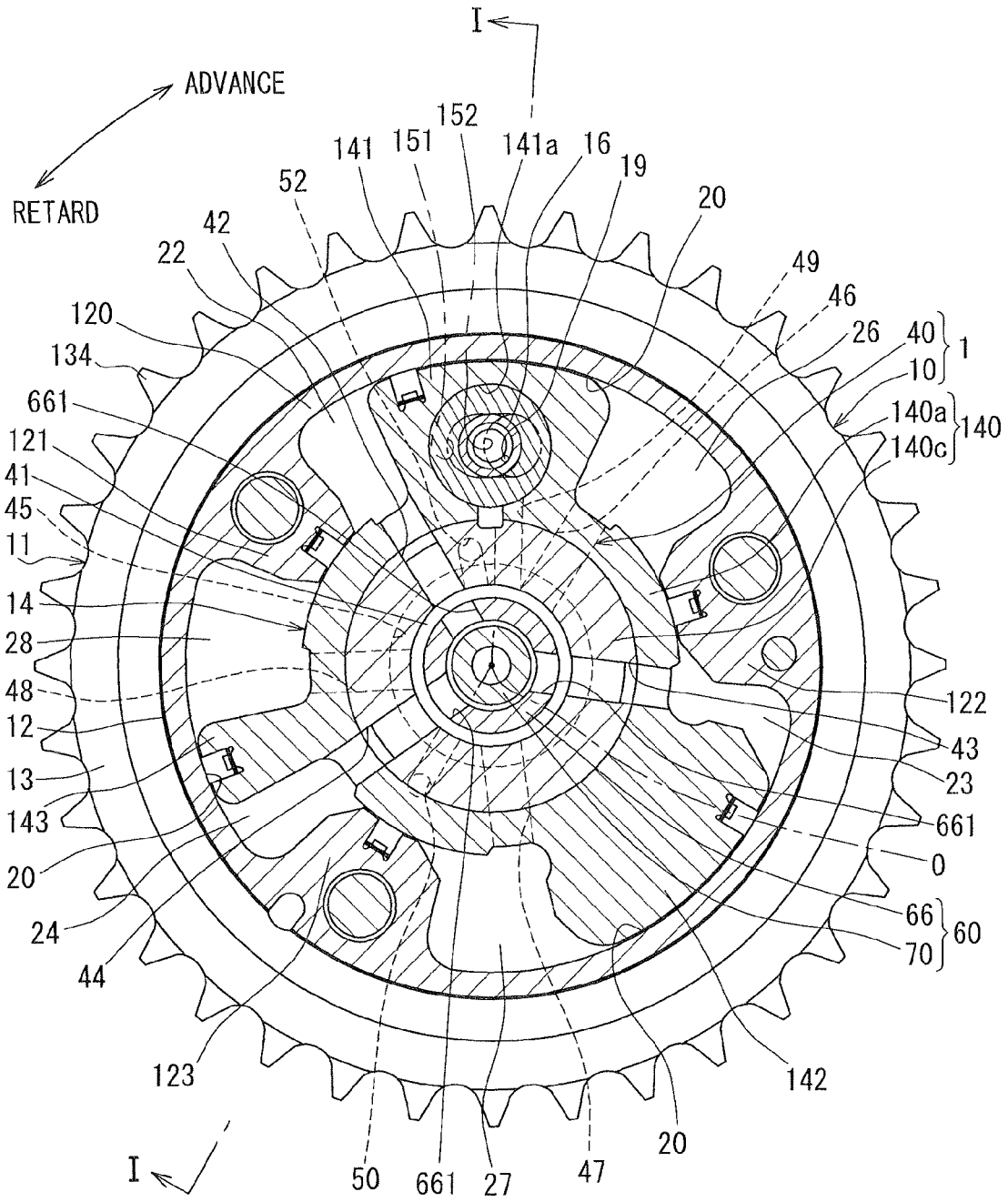
FIG. 2 is a sectional view taken along the line II-II in FIG. 1.

As follows, the control portion 40 will be described in detail. As shown in FIG. 1 and FIG. 2, in the control portion 40, an advance main passage 41 is formed along the inner circumferential periphery of the rotation axis 140. Advance branch passages 42, 43, 44 extend through the rotation axis 140. The advance branch passages 42, 43, 44 respectively communicate with the corresponding advance chambers 22, 23, 24 and the common advance main passage 41.

A retard main passage 45 is defined by an annular groove opened in the inner circumferential periphery of the rotation axis 140. The retard branch passages 46, 47, 48 extend through the rotation axis 140 and respectively communicate with the corresponding retard chambers 26, 27, 28 and the common retard main passage 45. A lock activation passage 49 extends through the rotation axis 140 and communicates with the lock chamber 17.

The main supply passage 50 extends through the rotation axis 140. The main supply passage 50 communicates with a pump 4, which functions as a supply source, through a conveyance passage 3 of the camshaft 2. The pump 4 is a mechanical pump driven by the crankshaft with a driving operation of the internal combustion engine. During the engine operation, the pump 4 regularly discharges working fluid drawn from a drain pan 5. The conveyance passage 3 is branched from a lubrication oil passage 6 communicating with a discharge port of the pump 4, thereby working oil discharged from the passage 6 is regularly sent, as the working fluid, toward the main supply passage 50 during the engine operation.

A sub-supply passage 52 extends through the rotation axis 140, and is branched from the main supply passage 50. The passage 52 receives working oil supplied from the pump 4 through the main supply passage 50.

A main check valve 500 having a valve element in a lead shape is provided to a portion of the main supply passage 50 on the side of the pump 4 from the branch point. The main check valve 500 restricts the working fluid from flowing into the pump 4 from the main supply passage 50.

A sub-check valve 520 having a valve element in a lead shape is provided in the sub-supply passage 52. The sub-check valve 520 restricts the working fluid from flowing toward the main passage 50 in the sub-supply passage 52.

A drain collection passage 54 is defined outside of the actuating portion 10 and the camshaft 2. The passage 54 is exposed to atmospheric air with the drain pan 5 corresponding to a drain collector, and the working oil is dischargeable from the passage 54 to the pan 5.

A control valve 60 is a spool valve to reciprocate a spool 70 in a sleeve 66 in the axis direction using an elastic biasing force generated by a biasing member 80 and a driving force generated by energizing an electromagnetic solenoid 90. The control valve 60 has an advance port 661, a retard port 662, a lock activation port 663, a main supply port 664, a sub-supply port 665, and a drain port 666.

The advance port 661 communicates with the advance main passage 41. The retard port 662 communicates with the retard main passage 45. The lock port 663 communicates with the lock activation passage 49.

The main supply port 664 communicates with the main supply passage 50. The sub-supply port 665 communicates with the sub-supply passage 52. The pair of the drain port 666 communicates with the drain collection passage 54. The control valve 60 switches the connection state among the ports 661, 662, 663, 664, 665, 666 based on a variation in the position of the spool 70.

A control circuit 96 is an electronic control device including, for example, a microcomputer and the like. The control circuit 96 is electrically connected with the solenoid 90 and devices (not shown) of the engine. The control circuit 96 controls energization of the solenoid 90 based on a program memorized in an internal memory. In addition, the control circuit 96 controls a driving operation of the internal combustion engine.

(Fluctuating Torque)

Figure 3:
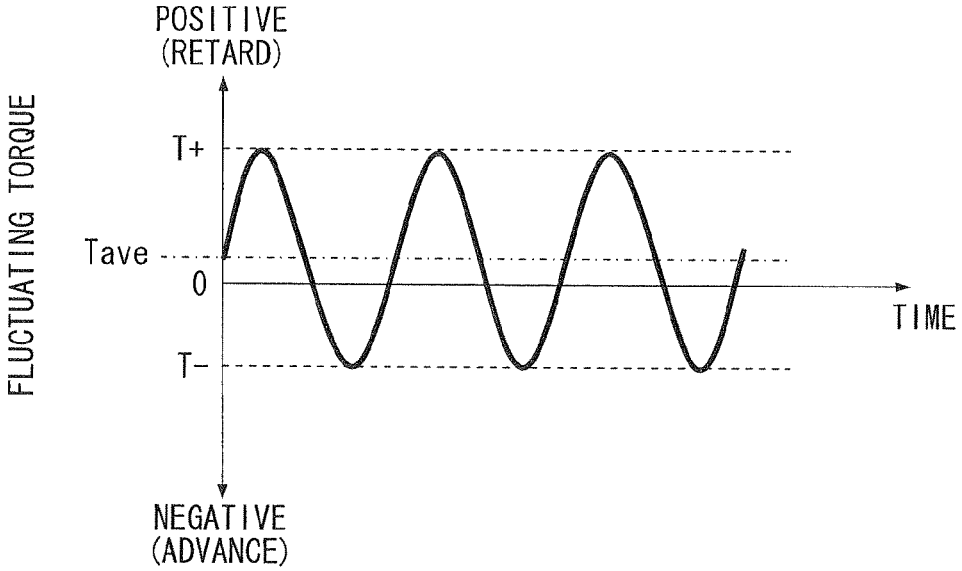
FIG. 3 is a graph showing a fluctuating torque applied to the valve timing control apparatus.

During an operation of the internal combustion engine, fluctuating torque is caused in the actuator portion 10 by a spring counter force from the intake valve, which is opened and closed by the camshaft 2, and the like, and such fluctuating torque acts on the vane rotor 14. As exemplified in FIG. 3, fluctuating torque alternates between negative torque, which acts on the vane rotor 14 to the advance side relative to the housing 11, and positive torque, which acts on the vane rotor 14 to the retard side relative to the housing 11. In the present embodiment, in particular, a peak torque T+ of fluctuating torque on the positive side is greater than a peak torque T− of fluctuating torque on the negative side due to friction between the camshaft 2 and a bearing, and the like. Thus, an average torque Tave of the peak torque T+ and the peak torque T− is biased toward the positive side. Therefore, during an operation of an internal combustion engine, the vane rotor 14 is biased toward the retard side relative to the housing 11 on average by being applied with fluctuating torque transmitted from the camshaft 2.

(Biasing Structure of Vane Rotor)

A first pin 150 is provided in the front plate 15, and has a column shape protruding from the plate 15 outward from the housing 11. The pin 150 extends approximately parallel with the rotation center O of the actuator portion 10, and a center location of the pin 150 is deviated from the rotation center O.

An arm 140*d* and a second pin 140*e* are provided in the bush 140*c* that is projected over the front plate 15. The arm 140*d* has a plate shape approximately parallel with the front plate 15. The second pin 140*e* has a column shape protruding from the arm 140*d* toward the front plate 15. The pin 140*e* extends approximately parallel with the rotation center O of the actuator portion 10, and a center location of the pin 140*e* is deviated from the rotation center O. The pin 140*e* is located in a manner that a distance between the pin 140*e* and the rotation center O becomes approximately the same as a distance between the pin 150 and the rotation center O. Further, the pin 140*e* is located to be distanced from a rotation trace of the pin 150 in the axis direction of the actuator portion 10.

In the rotation axis 140, a metallic assist spring 18 is provided to the outer circumferential periphery of the bush 140*c*. The spring 18 is formed in a swirl-shape within a plane, and has a swirl center, which is aligned to the rotation center O of the rotation axis 140 and located between the front plate 15 and the arm 140*d*. An inner circumference end of the spring 18 is wound around an outer periphery of the bush 140*c* so as to form an entangled part 180. An outer circumference end of the spring 18 is bent in U-shape so as to form a stopper part 181. The stopper part 181 is stopped by the first pin 150 or the second pin 140*e* correspondingly to the rotation phase.

In a state where the rotation phase is changed into the retard side than the middle lock phase, the stopper part 181 of the spring 18 is stopped by the first pin 150 of the housing 11. At this time, the second pin 140*e* of the vane rotor 14 is separated from the stopper part 181, so that the vane rotor 14 receives a recovering force generated when the assist spring 18 has the distorted elastic deformation. Thus, the vane rotor 14 is biased toward the middle lock phase on the advance side. For example, the recovering force of the spring 18 biasing the vane rotor 14 toward the advance side is set to become larger than the average value of the fluctuating torque biased on the retard side.

In contrast, when the rotation phase is changed into the advance side than the middle lock phase, the stopper part 181 of the spring 18 is stopped by the second pin 140*e* of the vane rotor 14. At this time, the first pin 150 of the housing 11 is separated from the stopper part 181, so that the biasing of the vane rotor 14 performed by the assist spring 18 is limited.

(Locking Structure of Rotation Phase)

Figure 4:
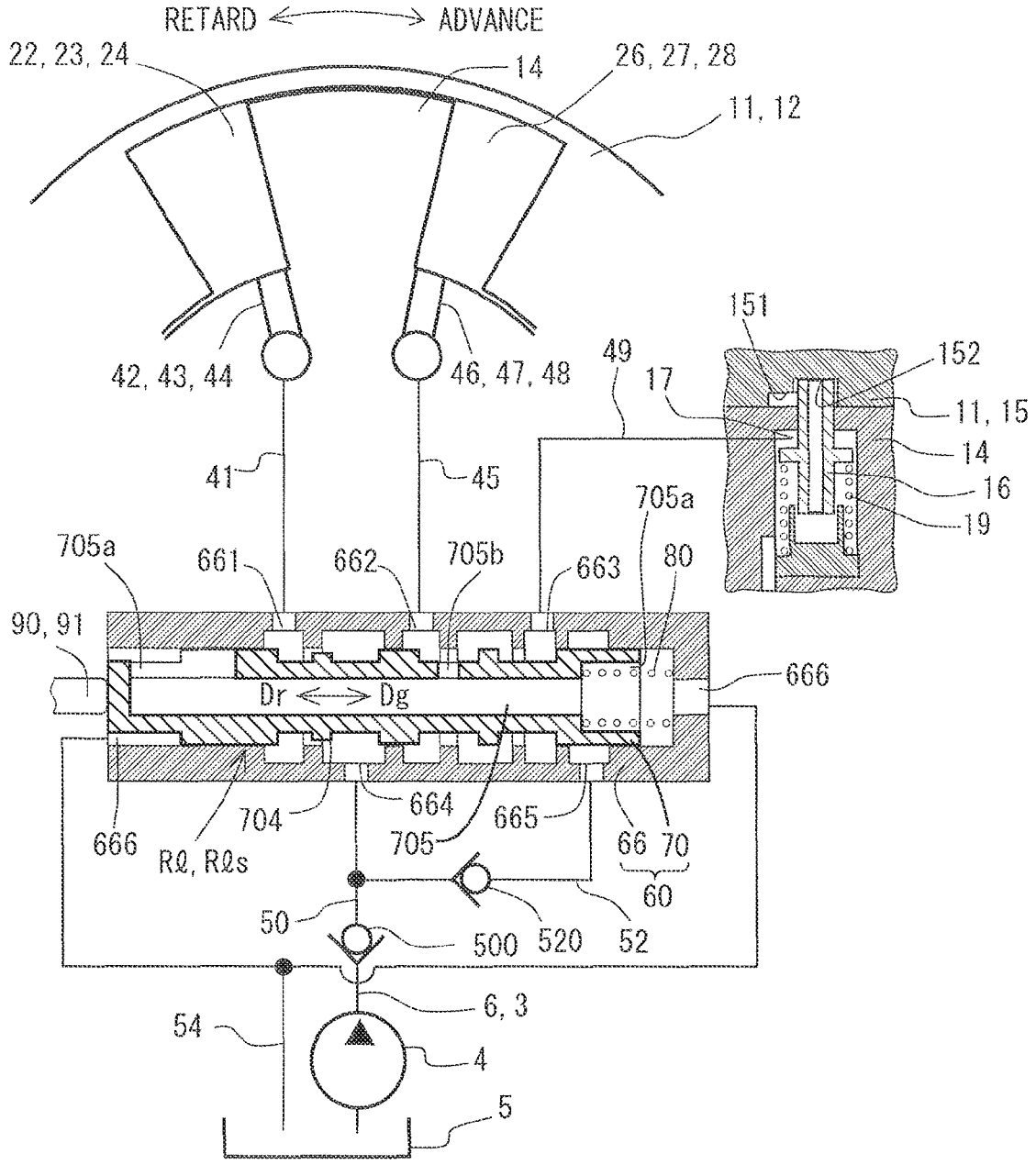
FIG. 4 is a schematic view showing a control valve of the valve timing control apparatus in an operational state.

Subsequently, a phase lock portion of the present embodiment that locks or unlocks the rotation phase will be described. As shown in FIGS. 1 and 2, a regulating recess 151 and a locking recess 152 are formed on the front plate 15. The regulating recess 151 is opened in the inner surface of the front plate 15 and extended in the rotative direction of the housing 11. The regulating recess 151 has both closed ends. The locking recess 152 is a bottomed cylindrical hole in parallel with the axis of the camshaft 2, and is located on a bottom face of an advance-side end of the regulating recess 151 (FIG. 4).

The vane 141 has an accommodation hole 141*a* that accommodates the cylindrical lock member 16. The lock member 16 is accommodated in parallel with the rotation center O of the actuator portion 10. The hole 141*a* opposes to the regulating recess 151 in the axis direction at the regulation area of the rotation phase. Further, the hole 141*a* opposes to the locking recess 152 in the axis direction at the middle lock phase.

A lock spring 19 made of metallic compression coil spring is coaxially accommodated in the hole 141*a* with the lock member 16. The spring 19 is interposed between a retainer 141*b* fixed to the vane 141 and the lock member 16, and has a compression elastic deformation, thereby producing a recovering force that biases the lock member 16 toward the front plate 15. Further, the lock chamber 17 is formed opposite from the hole 141*a* through the lock member 16 in the axis direction, and is located opposite from the lock spring 19. Working oil is introduced into the lock chamber 17, and the lock member 16 receives a pressure of the working oil, so that the lock member 16 is movable away from the front plate 15 against the recovering force of the lock spring 19.

In a state where the lock member 16 is separated from the regulating recess 151 and the locking recess 152, when working oil is discharged from the lock chamber 17, the lock member 16 is moved toward the front plate 15, and fits with the regulating recess 151. Thereby, the rotation phase regulated to the regulation area reaches the middle lock phase by receiving the fluctuating torque and the recovering force of the spring 18. Then, the lock member 16 further moves toward the front plate 15 and is fitted with the locking recess 152. Thus, the rotation phase is locked into the middle lock phase, so that the change in the valve timing corresponding to the rotation phase is securely limited.

In contrast, in a state where the lock member 16 is fitted with the locking recess 152 through the regulating recess 151, when working oil having a predetermined pressure or more is introduced into the lock chamber 17, the lock member 16 is moved away from the front plate 15, so as to be separated from the regulating recess 151 and the locking recess 152. Thereby, the regulation and the lock of the rotation phase are released, so that the valve timing can be flexibly controlled correspondingly to the rotation phase.

(Detailed Structure of Control Valve)

Detailed structure of the control valve 60 will be described. As shown in FIG. 1, the control valve 60 has the metallic cylindrical sleeve 66 coaxially arranged with the camshaft 2 and the rotor 14. The sleeve 66 has a fix part 667 having a male thread fixed to the camshaft 2 at a first end, and a ring flange 668 at a second end. The rotation axis 140 of the rotor 14 is disposed between the camshaft 2 and the flange 668. As shown in FIG. 4, the sleeve 66 has the drain port 666, the advance port 661, the main supply port 664, the retard port 662, the lock activation port 663, the sub-supply port 665 and the drain port 666 in this order from the second end to the first end.

The metallic cylindrical spool 70 is coaxially accommodated in the sleeve 66, and is slidably supported by an inner circumference face of the sleeve 66, so that the spool 70 reciprocates in a first direction Dg and a second direction Dr in the axis direction. When the spool 70 is moved in the first direction, the spool 70 is moved rightward from the side of the flange 668 to the side of the fix part 667. When the spool 70 is moved in the second direction, the spool 70 is moved leftward from the side of the fix part 667 to the side of the flange 668.

The spool 70 has a throttle 704 for throttling the flowing amount of the working oil between the advance port 661 and the main supply port 664, at a predetermined position. Alternatively, the throttling may be performed by making the outer diameter of the outer circumference face of the throttle 704 smaller than the inner diameter of the inner circumference face of the sleeve 66 so as to form a clearance between the outer circumference face of the throttle 704 and the inner circumference face of the sleeve 66 in the radial direction. Alternatively, the inner circumference face of the sleeve 66 and the outer circumference face of the throttle 704 are slidably moved by the fitting, which is not illustrated, thereby shortening the sealing length of the sliding face in the axis direction, so as to throttle the flowing amount of the working oil.

The spool 70 has a communication passage 705 extending in the axis direction at a center position in the radial direction The communication passage 705 has a first port 705*a* at both ends of the spool 70 in the axis direction. The port 705*a* communicates with the drain port 666 irrespective of the movable position of the spool 70.

The communication passage 705 further has a second port 705*b* that opens in the outer periphery of the spool 70. The communication passage 705 is communicable with one of the retard port 662 and the lock port 663 through the second port 705*b* according to the moving position of the spool 70.

Figure 5:
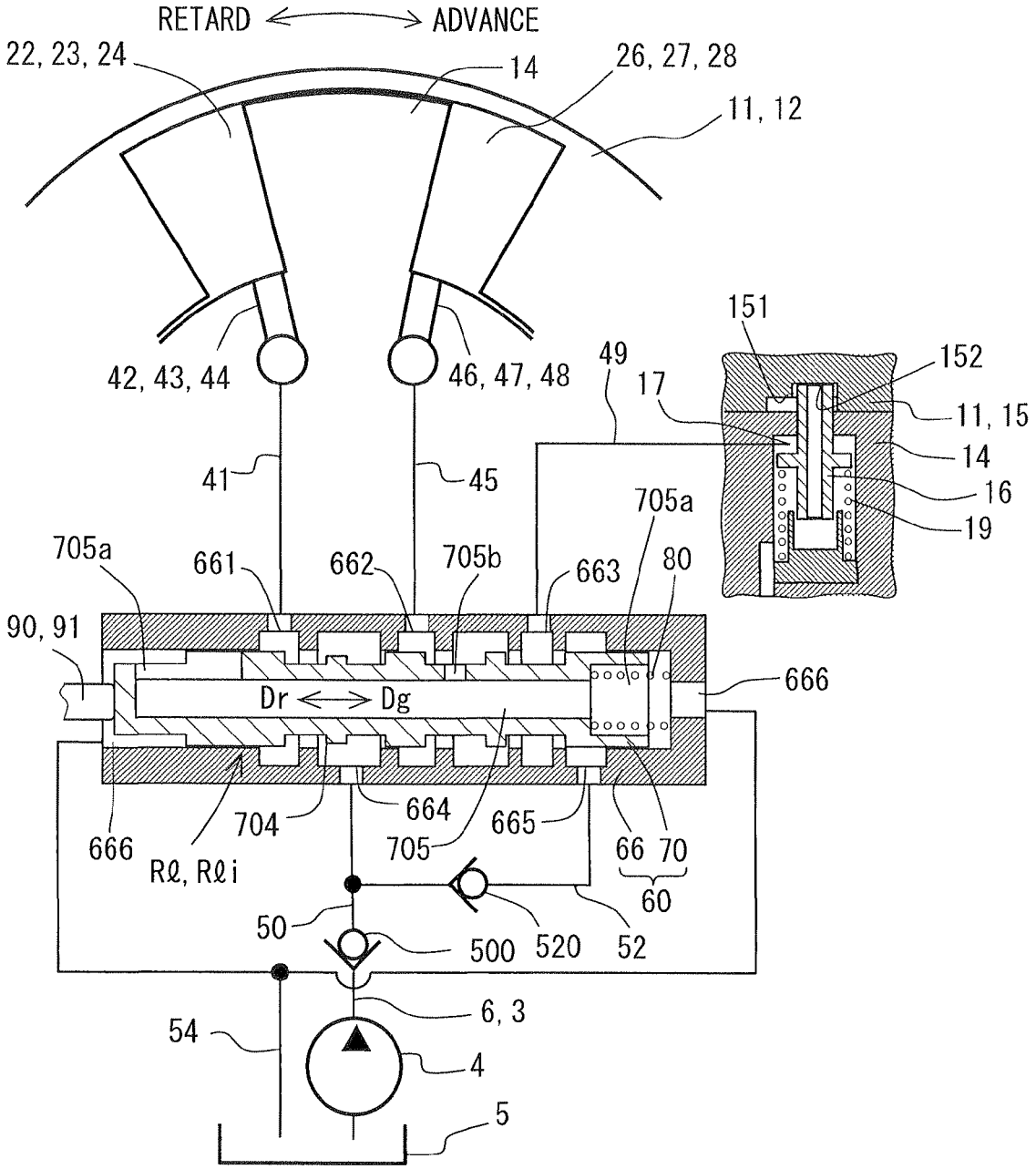
FIG. 5 is a schematic view showing the control valve in an operational state different from FIG. 4.

When the spool 70 is positioned in the lock region Rl, as shown in FIGS. 4 and 5, the advance port 661 is connected to the main supply port 664. At this time, the working oil supplied from the pump 4 to the passage 6, 3, 50 is introduced into the advance chamber 22, 23, 24 through the port 664, 661 and the passage 41, 42, 43, 44.

Further, the retard port 662 is connected to the drain port 666 through the passage 705. At this time, the working oil of the retard chamber 26, 27, 28 is discharged into the drain pan 5 downstream of the passage 54 through the passage 46, 47, 48, 45 and the port 662, 666.

Furthermore, the lock activation port 663 is connected to the drain port 666 through the passage 705. At this time, the working oil of the lock chamber 17 is discharged into the drain pan 5 downstream of the passage 54 through the passage 49 and the port 663, 666.

Figure 9:
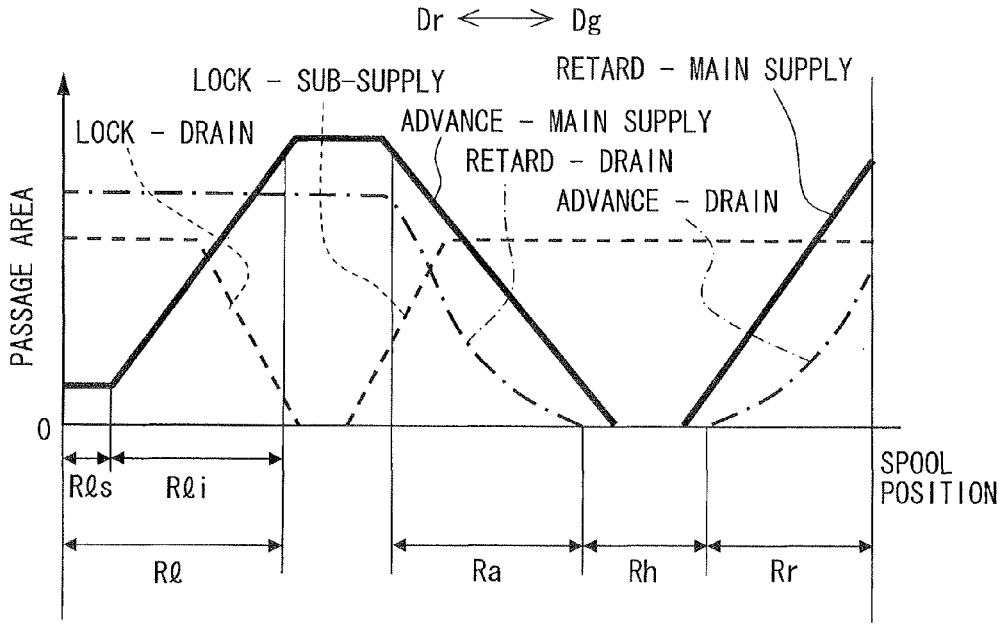
FIG. 9 is a graph showing characteristics of the control valve.

As shown in FIG. 9, the lock region Rl is divided into a throttle region Rls and an increasing region Rli. Specifically, as shown in FIG. 4, the throttle region Rls is set at an end position of all of the movable area of the spool 70, that includes the lock region Rl, in the second direction Dr. In the throttle region Rls, the flowing amount of the working oil introduced from the main supply port 664 into the advance chamber 22, 23, 24 through the advance port 661 is reduced by the throttle 704.

In contrast, as shown in FIG. 9, the increasing region Rli is set to be located adjacent to the throttle region Rls of the lock region Rl in the first direction Dg. In the increasing region Rli, the flowing amount of the working oil introduced from the main supply port 664 into the advance chamber 22, 23, 24 through the advance port 661 is gradually increased, as the spool 70 is separating from the throttle region Rls in the first direction Dg. The increasing region Rli is larger than the throttle region Rls.

When the spool 70 moves from the lock region Rl to the advance region Ra, as shown in FIG. 9, in the first direction Dg, the advance port 661 is connected with the main supply port 664. At this time, the working oil supplied from the pump 4 to the passage 6, 3, 50 is introduced into the advance chamber 22, 23, 24 through the port 664, 661 and the passage 41, 42, 43, 44.

Further, the retard port 662 is connected to the drain port 666 through the passage 705. At this time, the working oil of the retard chamber 26, 27, 28 is discharged into the drain pan 5 downstream of the passage 54 through the passage 46, 47, 48, 45 and the port 662, 666.

Furthermore, the lock activation port 663 is connected to the sub-supply port 665. At this time, the working oil supplied from the pump 4 to the passage 6, 3, 50, 52 is introduced into the lock chamber 17 through the port 665, 663 and the passage 49.

When the spool 70 moves from the advance region Ra to the holding region Rh, as shown in FIG. 9, in the first direction Dg, the advance port 661 and the retard port 662 are disconnected from any other port. At this time, the working oil can be held in the advance chamber 22, 23, 24 and the retard chamber 26, 27, 28.

Further, the lock activation port 663 is connected to the sub-supply port 665. At this time, the working oil supplied from the pump 4 to the passage 6, 3, 50, 52 is introduced into the lock chamber 17 through the port 665, 663 and the passage 49.

When the spool 70 moves from the holding region Rh to the retard region Rr, as shown in FIG. 9, in the first direction Dg, the advance port 661 is connected with the drain port 666 through the passage 705. At this time, the working oil of the advance chamber 22, 23, 24 is discharged into the drain pan 5 downstream of the passage 54 through the passage 42, 43, 44, 41 and the port 661, 666.

Further, the retard port 662 is connected to the main supply port 664. At this time, the working oil supplied from the pump 4 to the passage 6, 3, 50 is introduced into the retard chamber 26, 27, 28 through the port 664, 662 and the passage 45, 46, 47, 48.

Furthermore, the lock activation port 663 is connected to the sub-supply port 665. At this time, the working oil supplied from the pump 4 to the passage 6, 3, 50, 52 is introduced into the lock chamber 17 through the port 665, 663 and the passage 49.

(Driving Structure of Control Valve)

Referring to FIG. 1, the control portion 40 for driving the control valve 60 is provided with the elastic member 80 corresponding to a biasing portion, and the electromagnetic solenoid 90 corresponding to an electric driving portion.

The elastic member 80 is made of a metallic compression coil spring coaxially disposed in the sleeve 66. The elastic member 80 is a biasing unit configured to generate resilience accompanied with elastic compression caused between the fix part 667 of the sleeve 66 and the end of the spool 70 adjacent to the fix part 667 so as to bias the spool 70 in the second direction Dr (FIG. 4).

As shown in FIG. 1, the solenoid 90 includes a metallic driving shaft 91. For example, the solenoid 90 is mounted to a chain cover fixed to an engine head of the internal combustion engine. The driving shaft 91 is formed in a rod shape and coaxially arranged on the opposite side of the fix part 667 of the spool 70. The driving shaft 91 is linearly movable in the axial direction.

Irrespective of the movable position of the spool 70, the driving shaft 91 is always in contact with the end of the spool 70 by entering one of the drain ports 666 in the sleeve 66 because the shaft 91 receives a recovering force from a spring (not shown) inside of the solenoid 90. The spring of the solenoid 90 is provided with a current controlled as a "instruction value" from the control circuit 96, so that the solenoid 90 generates a driving force corresponding to the current in a manner that the spool 70 is driven in the first direction Dg by the shaft 91 (FIG. 4).

In the present condition, the spool 70 moves to a position in which the driving force caused for the shaft 91 by the solenoid 90 is balanced with the biasing force of the elastic member 80. In the present structure, when the current from the control circuit 96 becomes zero, the driving force generated by the solenoid 90 disappears. At this time, the spool 70 that receives the elastic force from the elastic member 80 in the second direction Dr reaches the moving end position in the second direction Dr. Therefore, at the fail time when the solenoid 90 cannot receive the current, in addition to the above-described case, the spool 70 is positioned at a predetermined position in the throttle region Rls set at the moving end position in the second direction Dr.

(Operation of Valve Timing Control Apparatus)

As follows, an operation of the valve timing control apparatus 1 will be described in detail.

(I) Advance Operation

Figure 6:
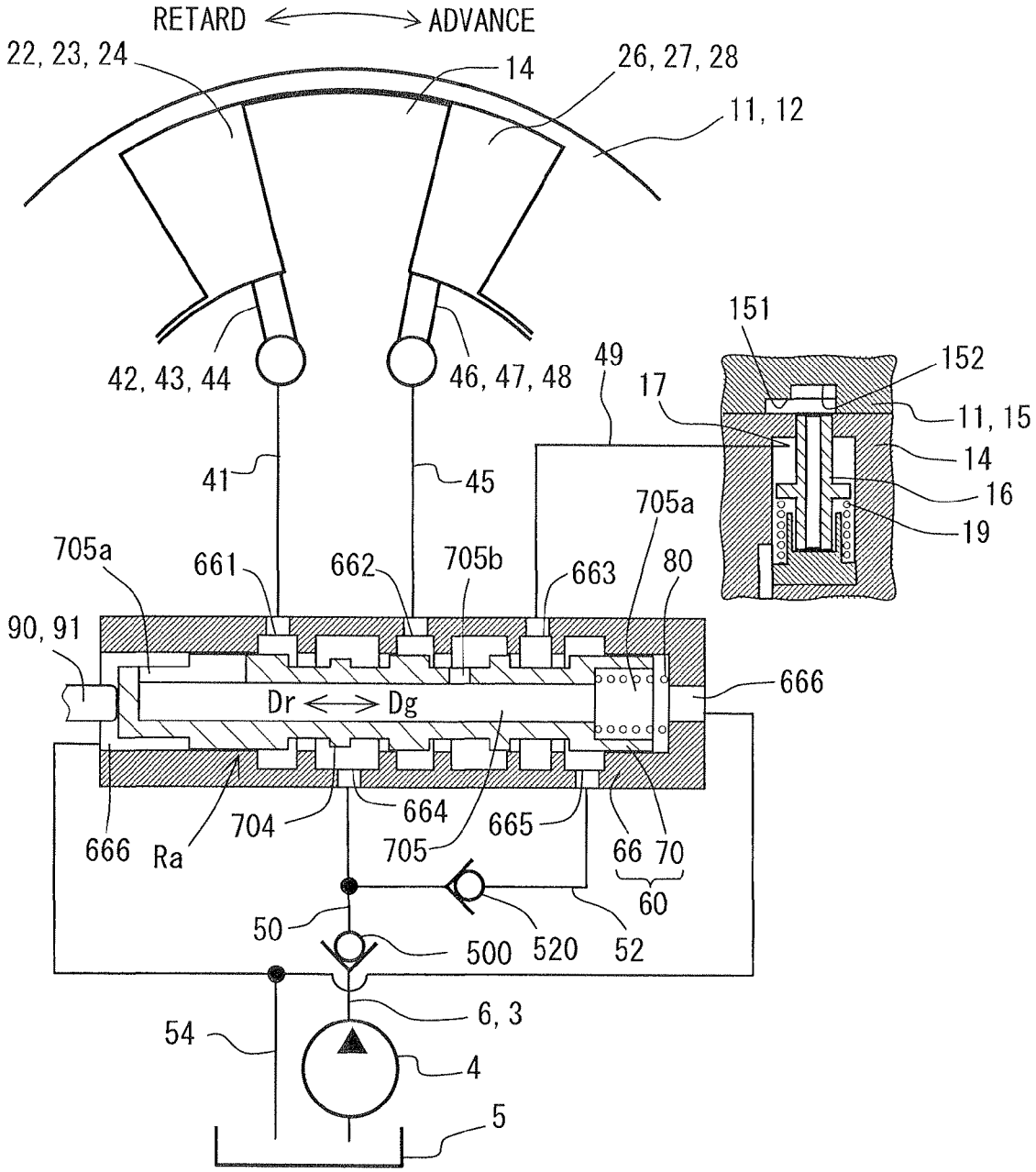
FIG. 6 is a schematic view showing the control valve in an operational state different from FIG. 4.

For example, while the engine is operated, if the actual phase is located on the retard side from the allowed deviation range of the target phase, the control circuit 96 controls the energization of the solenoid 90. Thereby, the control circuit 96 controls the spool 70 to move to the advance region Ra shown in FIG. 6.

Consequently, the advance port 661 is communicated with the main supply port 664, and a working fluid is supplied from the pump 4 into each of the advance chambers 22, 23, 24. In addition, the retard port 662 is communicated with the drain port 666, and a working fluid is discharged from each of the retard chambers 26, 27, 28. Further, the lock port 663, which is communicated with the lock chamber 17 through the passage 49, and the sub-supply port 665, which is communicated with the pump 4 through the passage 6, 3, 50, 52, are communicated with other. Thus, working fluid is supplied into the lock chamber 17.

As described above, working fluid is supplied into each of the advance chambers 22, 23, 24 and discharged from each of the retard chambers 26, 27, 28 in the state where the lock of the rotation phase is released by supplying a working fluid into the lock chamber 17. Therefore, the valve timing can be quickly advanced.

(II) Holding Operation

Figure 7:
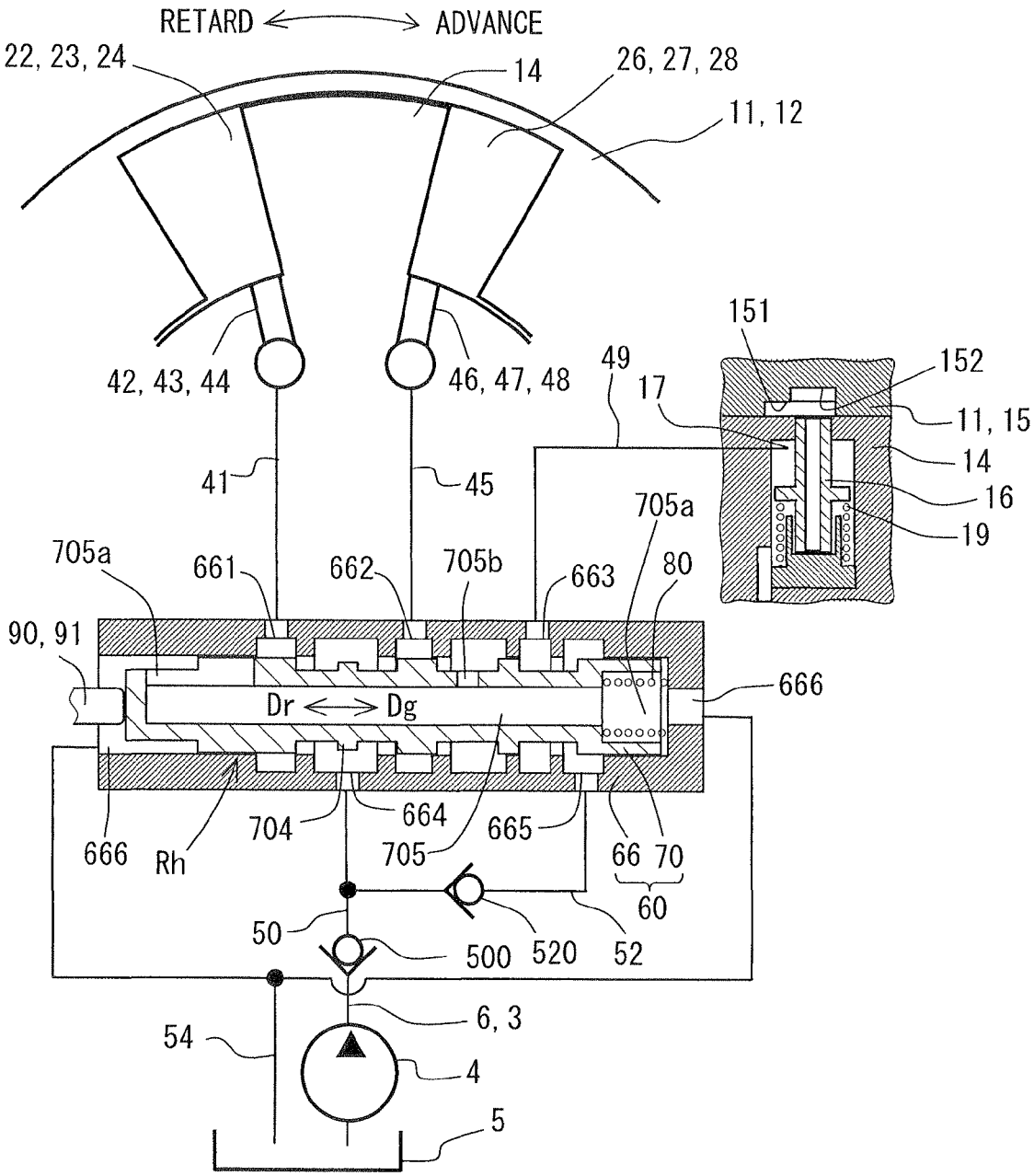
FIG. 7 is a schematic view showing the control valve in an operational state different from FIG. 4.

For example, while the engine is operated, if the actual phase is located in the allowed deviation range of the target phase, the control circuit 96 controls the energization of the solenoid 90. Thereby, the control circuit 96 controls the spool 70 to move to the holding region Rh shown in FIG. 7.

Consequently, the advance port 661, which is communicated with each of the advance chambers 22, 23, 24 through the passages 41, 42, 43, 44, is blocked from the others ports. Therefore, supply of a working fluid into each of the advance chambers 22, 23, 24 is stopped, and a working fluid is accumulated in each of the advance chambers 22, 23, 24. In addition, the retard port 662, which is communicated with each of the retard chambers 26, 27, 28 through the passages 45, 46, 47, 48, is blocked from the others ports. Therefore, supply of a working fluid into each of the retard chambers 26, 27, 28 is stopped, and a working fluid is accumulated in each of the retard chambers 26, 27, 28. Furthermore, accompanied with the advance operation (I), the lock port 663 and the sub-supply port 665 are communicated with each other. Thus, a working fluid is supplied into the lock chamber 17.

As described above, when the spool 70 is in the holding region Rh, a working fluid is held in each of the advance chambers 22, 23, 24 and each of the retard chambers 26, 27, 28 in the state where the lock of the rotation phase is released by supplying a working fluid into the lock chamber 17. In this manner, the valve timing can be maintained in a variation range of the rotation phase affected by the fluctuating torque.

(III) Retard Operation

Figure 8:
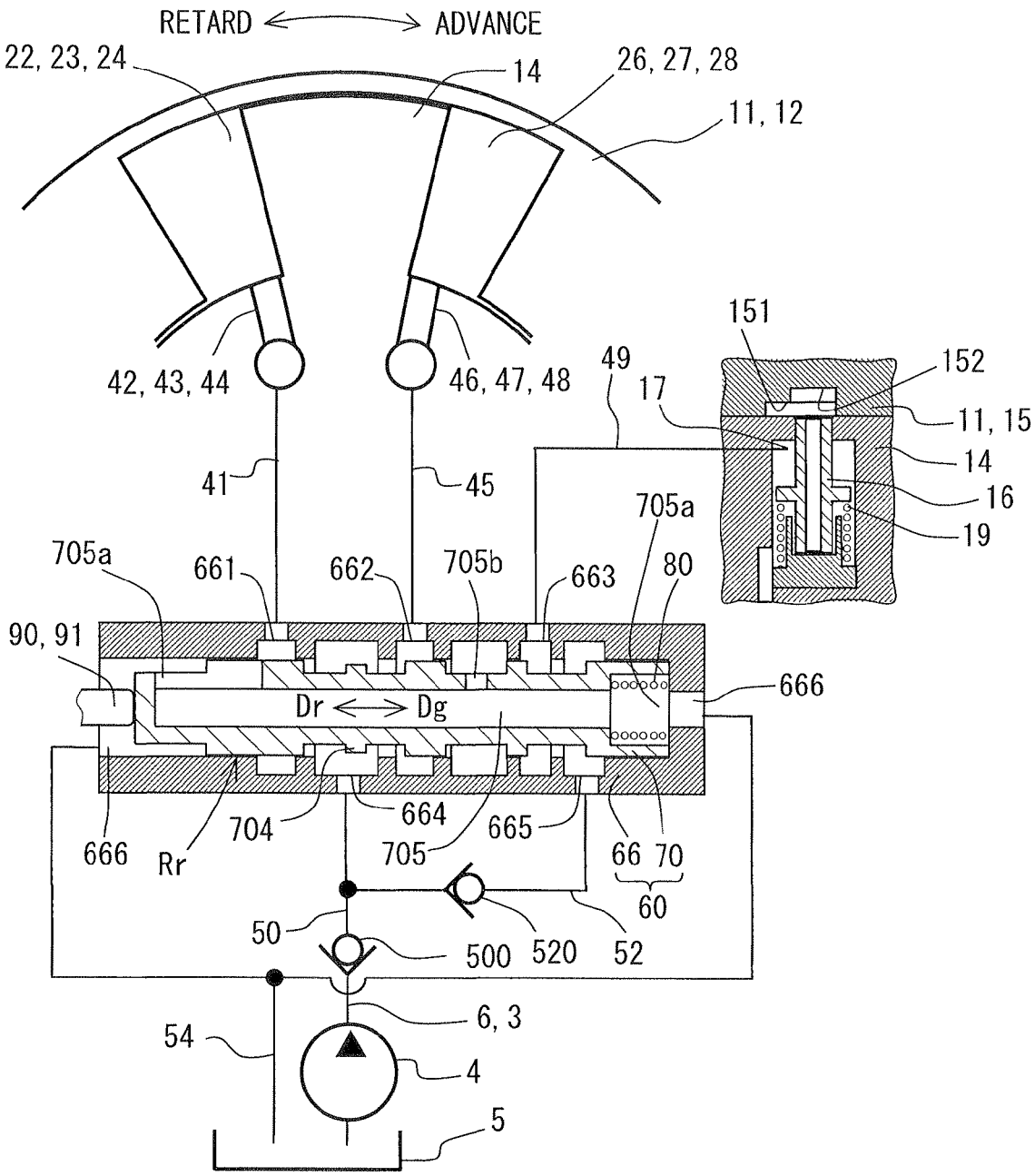
FIG. 8 is a schematic view showing the control valve in an operational state different from FIG. 4.

For example, while the engine is operated, if the actual phase is located on the advance side from the allowed deviation range of the target phase, the control circuit 96 controls the energization of the solenoid 90. Thereby, the control circuit 96 controls the spool 70 to move to the retard region Rr shown in FIG. 8.

Consequently, the advance port 661, which communicates with each of the advance chambers 22, 23, 24 through the passages 41, 42, 43, 44, and the drain port 666, which communicates with the passage 54, are communicated with each other through the passage 705. Thus, a working fluid is discharged from each of the advance chambers 22, 23, 24.

In addition, the retard port 662, which communicates with each of the retard chambers 26, 27, 28 through the passages 45, 46, 47, 48, and the main supply port 664, which communicates with the pump 4, are communicated with each other through the passages 45, 46, 47, 48. Thus, a working fluid is supplied from the pump 4 into each of the retard chambers 26, 27, 28. Furthermore, accompanied with the advance operation (I), the lock port 663 and the sub-supply port 665 are communicated with each other. Thus, a working fluid is supplied into the lock chamber 17.

As described above, when the spool 70 is in the retard region Rr, a working fluid is supplied into the lock chamber 17 to release the lock of the rotation phase. Thus, a working fluid is supplied into each of the retard chambers 26, 27, 28, and a working fluid is discharged from each of the advance chambers 22, 23, 24, in the state where the lock of the rotation phase is released. Therefore, the valve timing can be quickly retarded.

(IV) Lock Operation

When the engine is in an idling operation, the pressure of working fluid is low. In such a condition, the control circuit 96 controls the energization of the solenoid 90 to be zero, thereby moving the spool 70 to the throttle region Rls of the lock region Rl.

Consequently, the advance port 661, which communicates with each of the advance chambers 22, 23, 24 through the passages 41, 42, 43, 44, and the main supply port 664, which communicates with the pump 4 through the passages 6, 3, 50 are communicated with each other. Thus, a working fluid throttled by the throttle 704 is supplied to each of the advance chambers 22, 23, 24.

In addition, the retard port 662, which communicates with each of the retard chambers 26, 27, 28 through the passages 45, 46, 47, 48, and the drain port 666, which communicate with the passage 54, are communicated with each other through the passage 705. Thus, a working fluid is discharged from each of the retard chambers 26, 27, 28.

Further, the lock port 663, which communicates with the lock chamber 17 through the passage 49, is further communicated with the drain port 666 through the passage 705. Thus, a working fluid is discharged from the lock chamber 17.

According to the lock operation, at the throttle region Rls of the lock region Rl, the introduction of the small amount of the working fluid into the advance chamber 22, 23, 24 is controlled, and the discharging of the working fluid from the retard chamber 26, 27, 28 and the lock chamber 17 is controlled. At this time, the rotating force generated by the introduction of the working fluid into the advance chamber 22, 23, 24 and the recovering force of the spring 18 are applied to the vane rotor 14 toward the advance side. Further, the fluctuating torque from the camshaft 2 is applied toward the retard side on average.

If the rotation phase reaches the regulation area when the forces are applied to the rotor 14 on the advance and retard sides, the lock member 16 enters the hole 151 so as to lock the rotation phase into the regulation area. Thereby, the lock member 16 easily fits with the lock hole 152 at the middle lock phase in the regulation area, so that the rotation phase can be securely locked during the operation of the engine. Moreover, after the rotation phase is locked, the advance operation can be prepared to be performed in a state that the advance chamber 22, 23, 24 is filled with the working fluid.

(V) Stop Operation

When the rotation of the engine is stopped in accordance with a stop signal for the engine switch, for example, the control circuit 96 stops or cuts the electricity supply for the solenoid 90, so that the spool 70 is driven into the throttle region Rls of the lock region Rl in FIG. 4. As a result, similarly to (IV), the advance port 661 and the main supply port 664 are communicated with each other. Thus, a working fluid throttled by the throttle 704 is supplied to each of the advance chambers 22, 23, 24. In addition, the retard port 662 and the lock port 663 are connected to the drain port 666. Thus, a working fluid is discharged from each of the retard chambers 26, 27, 28.

According to the stop operation, similarly to (IV), if the rotation phase reaches the regulation area when the forces are applied to the rotor 14 on the advance and retard sides, the lock member 16 enters the hole 151 so as to lock the rotation phase into the regulation area. Thereby, the lock member 16 easily fits with the lock hole 152 at the middle lock phase in the regulation area, so that the rotation phase can be securely locked before the rotation of the engine is completely stopped.

(VI) Start Operation

When the rotation of the engine is started in accordance with an activation signal for the engine switch, for example, the control circuit 96 controls the electricity supply for the solenoid 90, so that the spool 70 is driven into the increasing region Rli of the lock region Rl in FIG. 5. As a result, the advance port 661 communicating with the advance chamber 22, 23, 24 through the passage 41, 42, 43, 44 and the main supply port 664 communicating with the pump 4 through the passage 6, 3, 50 are connected with each other. Thus, the increased amount of working fluid is supplied to each of the advance chambers 22, 23, 24. In addition, the retard port 662 and the lock port 663 are connected to the drain port 666. Thus, a working fluid is discharged from each of the retard chambers 26, 27, 28 and the lock chamber 17.

According to the start operation, in the increasing region Rli of the lock region Rl, the working fluid is maintained to be discharged from the retard chambers 26, 27, 28 and the lock chamber 17, and the increased amount of working fluid is supplied to each of the advance chambers 22, 23, 24, compared with (IV). That is, the flow rate of the working fluid in the increasing region Rli is larger than that in the throttle region Rls. Thus, in the period of the starting operation, while the middle lock phase is maintained, the advance chamber 22, 23, 24 is filled with the working fluid so as to prepare for the advance operation.

If a stall is generated in the engine, the engine may be stopped before the rotation phase is locked. Even in the start operation after the stall, due to the increasing region Rli, while the working fluid is maintained to be discharged from the retard chambers 26, 27, 28 and the lock chamber 17, the working fluid can be supplied to each of the advance chambers 22, 23, 24. At this time, the rotating force generated by the introduction of the working fluid into the advance chamber 22, 23, 24 and the recovering force of the spring 18 are applied to the vane rotor 14 toward the advance side. Further, the fluctuating torque from the camshaft 2 is applied toward the retard side on average. If the rotation phase reaches the regulation area when the forces are applied to the rotor 14 on the advance and retard sides, the lock member 16 enters the hole 151 so as to lock the rotation phase into the regulation area. Thereby, the lock member 16 easily fits with the lock hole 152 at the middle lock phase in the regulation area, so that the rotation phase can be securely locked during the period of the starting operation.

(VII) Fail-Safe Operation

If a fail is generated during the rotation of the engine, for example, an open circuit is generated between the control circuit 96 and the solenoid 90, the current supplied to the solenoid 90 becomes zero, so that the spool 70 is driven into the throttle region Rls of the lock region Rl in FIG. 4 because the driving force of the solenoid 90 disappears. As a result, similarly to (IV), the advance port 661 and the main supply port 664 are communicated with each other. Thus, a working fluid throttled by the throttle 704 is supplied to each of the advance chambers 22, 23, 24. In addition, the retard port 662 and the lock port 663 are connected to the drain port 666. Thus, a working fluid is discharged from each of the retard chambers 26, 27, 28.

According to the fail-safe operation, similarly to (IV), if the rotation phase reaches the regulation area when the forces are applied to the rotor 14 on the advance and retard sides, the lock member 16 enters the hole 151 so as to lock the rotation phase into the regulation area. Thereby, the lock member 16 easily fits with the lock hole 152 at the middle lock phase in the regulation area, so that the rotation phase can be securely locked even at the fail time when the controlling of the solenoid 90 by the circuit 96 is difficult.

(Advantages)

In the advance region Ra of the control valve 60 of the apparatus 1, the lock port 663 communicating with the lock chamber 17 and the advance port 661 communicating with the advance chamber 22, 23, 24 are connected to the supply port 665, 664, respectively, to which the working fluid is supplied from the pump 4. When the working fluid is introduced into the lock chamber 17, the rotation phase is unlocked and is changed to the advance side.

In contrast, in the lock region Rl, the advance port 661 is connected to the main supply port 664, and the lock port 663 is connected to the drain port 666 that discharges the working fluid. The rotation phase can be locked by the working fluid discharged from the lock chamber 17 in the state where the advance chamber 22, 23, 24 is filled with the working fluid supplied from the supply port 664 through the advance port 661.

When the spool 70 is moved from the throttle region Rls or the increasing region Rli of the lock region Rl to the advance region Ra, the working fluid is introduced into the advance chamber 22, 23, 24 that is already in the filled state. Therefore, the rotation phase can be quickly changed so that the valve timing can be quickly advanced.

Further, a part of the lock region Rl is set as the throttle region Rls that throttles the amount of working fluid flowing from the main supply port 664 to the advance port 661. Therefore, if the spool 70 is moved from the advance region Ra to the throttle region Rls, the flowing amount of the working fluid from the advance port 661 to the advance chamber 22, 23, 24 is reduced, so that the variation amount of the rotation phase can be reduced. Thus, the rotation phase can be easily locked into the middle lock phase.

At the fail time when the solenoid 90 cannot receive the electricity from the control circuit 96, the spool 70 which is biased by the elastic member 80 in the second direction Dr reaches the end of the movable area of the spool 70 in the second direction Dr. According to the embodiment, the throttle region Rls is set at the movable end of the spool 70 in the second direction Dr, so that the flowing amount of the working fluid from the supply port 664 to the advance port 661 can be securely throttled because the spool 70 is moved to the movable end by the fail. Thus, even at the fail time, the variation amount of the rotation phase is restricted from increasing because the flowing amount of the working fluid from the advance port 661 to the advance chamber 22, 23, 24 is reduced. That is, the rotation phase can be easily locked at the middle lock phase. Accordingly, the fail safe property can be raised in addition to the high advance responsivity of the valve timing.

The pump 4 is driven by the rotation of the engine, so that the pressure of the working fluid supplied from the pump 4 to the main supply port 664 of the control valve 60 becomes high as the rotation speed of the engine is increased. Therefore, at the fail time where the spool 70 reaches the movable end in the second direction Dr, the rotation phase is difficult to be locked because the flowing amount of the working fluid from the advance port 661 to the advance chamber 22, 23, 24 is increased if the flowing amount of the working fluid from the main supply port 664 to the advance port 661 is not throttled.

According to the present embodiment, the throttle region Rls is set at the movable end of the spool 70 in the second direction Dr. The amount of the working fluid flowing into the advance port 661 is securely reduced at the fail time, and the amount of working fluid introduced into the advance chamber 22, 23, 24 is reduced. Therefore, the rotation phase can be easily locked, so that the high fail-safe property can be achieved.

Further, the working oil flowing from the pump 4 is branched into the main supply port 664 as a lubricating oil that lubricates the engine. The pressure of the branched working oil is raised as the environmental temperature is lowered because the viscosity is increased. Therefore, at the fail time where the spool 70 reaches the movable end in the second direction Dr, the rotation phase is difficult to be locked because the flowing amount of the working fluid from the advance port 661 to the advance chamber 22, 23, 24 is increased if the flowing amount of the working fluid from the main supply port 664 to the advance port 661 is not throttled.

According to the present embodiment, the throttle region Rls is set at the movable end of the spool 70 in the second direction Dr. The amount of the working fluid flowing into the advance port 661 is securely reduced at the fail time, and the amount of working fluid introduced into the advance chamber 22, 23, 24 is reduced. Therefore, the rotation phase can be easily locked, so that the high fail safe property can be achieved.

In the lock region Rl, while the working fluid is introduced from the main supply port 664 to the advance chamber 22, 23, 24 through the advance port 661, the rotation phase is locked at the middle lock phase defined between the most advance phase and the most retard phase by the working fluid discharged from the lock chamber 17. At this time, the rotation force is applied to the rotor 14 on the advance side by the introduced fluid against the fluctuating torque received by the rotor 14 averagely biased to the retard side, so that the rotation phase can be locked into the middle lock phase in the state where the variation amount of the rotation phase is restricted.

Further, in the throttle region Rls into which the spool 70 is moved at the fail time, the amount of the working fluid introduced into the advance chamber 22, 23, 24 is reduced, so that the effect is raised to restrict the variation amount of the rotation phase. Therefore, the rotation phase can be easily locked into the middle lock phase, so that the high fail safe property can be achieved.

The control circuit 96 stops the electricity supply for the solenoid 90 when the engine is rotated or stopped. The spool 70 is moved to the throttle region Rls located at the movable end of the spool 70 in the second direction Dr, so that the amount of working fluid flowing from the main supply port 664 to the advance port 661 can be securely reduced. Thereby, the amount of the working fluid introduced from the advance port 661 to the advance chamber 22, 23, 24 is reduced, so that the variation amount of the rotation phase can be restricted. The rotation phase can be easily locked at the middle loch phase in the throttle region Rls of the lock region Rl.

Especially, when the engine is stopped, the rotation phase can be easily locked, thereby the starting of the engine can be achieved by cranking the engine from the middle lock phase at the next starting time.

When the engine is started, the energization of the solenoid 90 is controlled. If the control circuit 96 drives the spool 70 into the increasing region Rli, the amount of the working fluid flowing from the main supply port 664 to the advance port 661 is increased, compared with the case of the throttle region Rls. Therefore, at the starting time, while the rotation phase is maintained to be locked at the middle lock phase, the amount of the working fluid introduced from the advance port 661 to the advance chamber 22, 23, 24 can be increased.

Thus, the rotation phase can be quickly changed by moving the spool 70 into the advance region Ra from the state where the advance chamber 22, 23, 24 is filled with the working fluid, because the amount of working fluid introduced into the advance chamber 22, 23, 24 is increased. For example, high advance responsivity can be achieved immediately after the starting.

Further, the increasing region Rli prepared for the starting time is located adjacent to the throttle region Rls prepared for the stop time in the first direction Dg. Therefore, a distance by which the spool 70 is moved between the throttle region Rls and the increasing region Rli can be shortened. Thus, the consumption electricity of the solenoid 90 necessary for driving the spool 70 from the throttle region Rls to the increasing region Rli can be restricted, so that the solenoid 90 can be operated even if the voltage of the on-vehicle battery is low at the starting time.

The advance port 661 may correspond to an introduction port, and the advance region Ra may correspond to a variable region.

Other Embodiment

As described above, the present invention is not limited to the above embodiments, and is capable of being applied to various embodiments as long as being undeviating from the gist thereof.

The position of the advance port 661 and the position of the retard port 662 may be changed with each other in the sleeve 66. In this case, the retard port 662 may correspond to the introduction port, and the retard region Rr is located adjacent to the lock region Rl in the first direction Dg so that the retard region Rr may correspond to the variable area. Further, the control valve 60 may be disposed in one of the camshaft 2 and the vane rotor 14, or may be disposed outside of the camshaft 2 and the vane rotor 14.

The biasing portion may be constructed by a plurality of elastic members other than the single elastic member 80. The electric driving portion may be a piezoactuator or oil-pressure actuator other than the solenoid 90. The control circuit 96 may drive the spool 70 to the movable end in the second direction Dr by controlling the current supplied to the solenoid 90 to be equal to or lower than a predetermined value. The control circuit 96 may move the spool 70 into the increasing region Rli when the engine is stopped, or may move the spool 70 into the throttle region Rls when the engine is started.

The pump 4 may be an electric pump other than the mechanical pump. The rotation phase may be locked at the most retard phase or the most advance phase other than the middle lock phase. In this case, the assist spring 18 may be omitted. Further, the regulation hole 151 may be omitted. Furthermore, the lock member 16 may be divided into plural parts, and each of the parts may be biased by the corresponding lock spring 19.

The valve timing control apparatus may be applied to a device that controls the valve timing of an exhaust valve other than the intake valve, or that controls the both of the exhaust valve and the intake valve.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A valve timing control apparatus for controlling a valve timing of a valve configured to be opened and closed by a camshaft in accordance with a torque transmitted from a crankshaft of an internal combustion engine by utilizing working fluid supplied from a supply source, the valve timing control apparatus comprising:

a housing rotatable with the crankshaft;

a vane rotor rotatable with the camshaft, the vane rotor partitioning an interior of the housing into an advance chamber and a retard chamber in a rotative direction, the vane rotor configured to change a rotation phase relative to the housing to an advance side or a retard side correspondingly when the working fluid is supplied into the advance chamber or the retard chamber, the vane rotor having a lock chamber;

a lock portion configured to lock the vane rotor relative to the housing when the working fluid is discharged from the lock chamber, the lock portion configured to release the lock when the working fluid is supplied into the lock chamber;

a spool that is configured to be linearly moveable in opposite directions including a first direction and a second direction;

a control valve configured to control a flow of the working fluid relative to the advance chamber, the retard chamber, and the lock chamber through the spool;

an electric driving portion configured to cause a driving force to move the spool in the first direction based on a command signal provided by a control circuit; and a bias unit configured to cause a biasing force to bias the spool in the second direction when being elastically deformed, wherein the control valve has:

an introduction port introducing the working fluid into one of the advance chamber and the retard chamber, a lock activation port communicating with the lock chamber, a supply port receiving the working fluid from the supply source, and a drain port draining the working fluid, the spool is moved in a variable region and a lock region, the rotation phase being unlocked and changed by connecting the introduction port and the lock activation port to the supply port in the variable region, the rotation phase being locked by connecting the introduction port to the supply port and by connecting the lock activation port to the drain port in the lock region, a part of the lock region includes a throttle region at which a flowing amount of the working fluid flowing from the supply port to the introduction port is throttled, the spool is configured to arrive to an end of a movable range in the second direction when the driving force of the electric driving portion is not applied to the spool, the throttle region is configured to be located at the end of the movable range of the spool in the second direction; and the working fluid is a lubricating oil that lubricates the engine, and the supply source supplies the working fluid to the supply port in a branched state.

2. The valve timing control apparatus according to claim 1, wherein the rotation of the engine drives the supply source to supply the working fluid to the supply port.

3. The valve timing control apparatus according to claim 1, wherein the lock portion locks the rotation phase at a middle lock phase defined between a most advance phase and a most retard phase by discharging the working fluid from the lock chamber, and the vane rotor receives a fluctuating torque averagely biased on the retard side from the camshaft.

4. The valve timing control apparatus according to claim 1, wherein the electric driving portion is configured, based on a command signal provided by the control circuit, to cause a stop of the driving force so as to move the spool to the throttle region.

5. The valve timing control apparatus according to claim 4, wherein the control circuit provides the command signal indicative of the stop of the driving force when the engine is stopped.

6. The valve timing control apparatus according to claim 5, wherein a part of the lock region located adjacent to the throttle region in the first direction is set as an increasing region at which the flowing amount of the working fluid from the supply port into the introduction port is increased than that in the throttle region, and the control circuit provides the command signal indicative of the start of the driving force when the engine is started.

7. The valve timing control apparatus according to claim 1, further configured to decrease the flowing amount of the working fluid flowing from the supply port to the introduction port as the spool moves in the second direction throughout a part of the lock region located adjacent to the throttle region.

8. The valve timing control apparatus according to claim 1, wherein the spool is configured to move to the end of the movable range in the second direction by only the biasing force of the bias unit at a fail time when the electric driving portion fails.

* * * * *

UNITED STATES PATENT AND TRADEMARK OFFICE

CERTIFICATE OF CORRECTION

PATENT NO. : 9,121,312 B2
APPLICATION NO. : 13/352465
DATED : September 1, 2015
INVENTOR(S) : Kawamura et al.

It is certified that error appears in the above-identified patent and that said Letters Patent is hereby corrected as shown below:

Title Page, Item (12) delete "Kawamura" and insert --Kawamura et al.--.

Title Page, Item (75) Inventor, should read

--(75) Inventors: Futoshi Kawamura, Kariya (JP); Takashi Yamaguchi, Obu (JP); Masaki Numakura, Toyota (JP); Yuu Yokoyama, Okazaki (JP)--.

Signed and Sealed this
Fifth Day of April, 2016

Michelle K. Lee

Michelle K. Lee
*Director of the United States Patent and Trademark Office*